United States Patent [19]

Oogami et al.

[11] 4,121,396

[45] Oct. 24, 1978

[54] CURTAIN WALL CONSTRUCTION

[75] Inventors: Eiryo Oogami, Kurobe; Isamu Matsubara, Nyuzen, both of Japan

[73] Assignee: Yoshida Kogyo K.K., Tokyo, Japan

[21] Appl. No.: 841,938

[22] Filed: Oct. 13, 1977

[30] Foreign Application Priority Data

Oct. 15, 1976 [JP] Japan ..... 51-139079[U]

[51] Int. Cl.[2] ..... E04H 1/00

[52] U.S. Cl. ..... 52/235; 52/403; 52/470

[58] Field of Search ..... 52/235, 475, 403, 465, 52/470, 459, 460, 395, 309.16

[56] References Cited

U.S. PATENT DOCUMENTS

| | | | |
|---|---|---|---|
| 3,373,537 | 3/1968 | Blayden | 52/465 X |
| 3,530,633 | 9/1970 | Scott | 52/235 X |
| 3,778,949 | 12/1973 | Hellerich | 52/309.16 X |
| 3,994,107 | 11/1976 | Aughuet | 52/235 |

*Primary Examiner*—Price C. Faw, Jr.
*Assistant Examiner*—Carl D. Friedman
*Attorney, Agent, or Firm*—Hill, Gross, Simpson, Van Santen, Steadman, Chiara & Simpson

[57] ABSTRACT

A curtain wall construction has a plurality of panel units arranged in a checkerboard pattern, each of the panel units including a panel and a frame extending peripherally around the panel. The frames jointly provide a plurality of channels therebetween which jointly provide channel crossings where they intersect. The channels receive therein backup bars and the channel crossings receive therein backup crossings, these backup bars and crossings being made of a resilient material and the backup crossings additionally including reinforcing core wires embedded therein. A caulking compound is applied to exposed surfaces of the backup crossing and backup bars to seal the seams.

6 Claims, 13 Drawing Figures

CURTAIN WALL CONSTRUCTION

BACKGROUND OF THE INVENTION

1. Field of the Invention

The present invention relates to a curtain wall construction.

2. Prior Art

It is known to put backup bars between adjacent ones of the panel units of a curtain wall and apply a caulking compound to the backup bars so as to fill up the seams. FIG. 12A of the accompanying drawings shows one such structure in which the backup bars that meet at an intersection are separate and subjected to deformation and damage when the panel units become displaced as illustrated in FIG. 12B. Accordingly, the applied caulking compound has become cracked or broken due to such displacement of the panel units, with the result that dust and water have entered through the cracks in the caulking compound into the building wherein they could impair floors and ceilings.

SUMMARY OF THE INVENTION

According to the present invention, at least four spaced panel units that constitute a curtain wall jointly provide four channels therebetween, the four channels jointly providing a channel crossing where they meet together. A backup crossing having four integral legs is disposed in the channel crossing, the backup crossing being made of a resilient material and having reinforcing core wires embedded in the legs. Backup bars made of a resilient material are disposed in the channels, the backup bars having ends held in abutting engagement with the distal ends of the legs of the backup crossing.

It is an object of the present invention to provide a curtain wall construction which is and will remain watertight along the junctions between its panel units.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
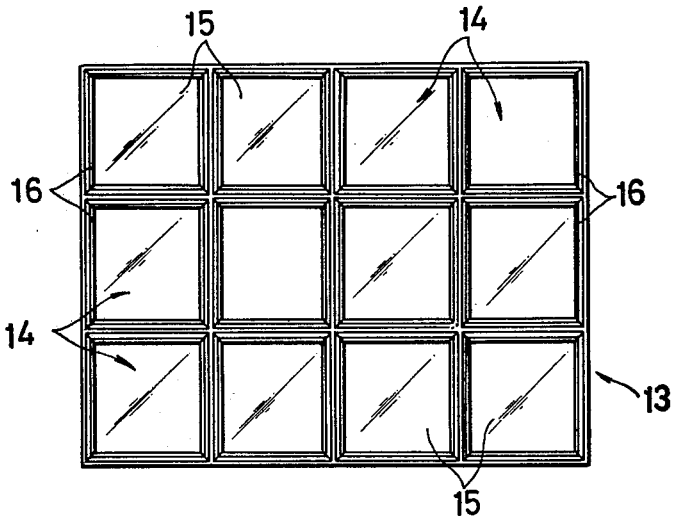
FIG. 1 is a front elevational view of a curtain wall construction according to the present invention.

As shown in FIG. 1, a curtain wall 13 adapted to be vertically mounted on a building framework (not shown) comprises a plurality of square panel units 14 arranged horizontally and vertically in a checkerboard pattern, the square panel units 14 each having a panel 15 such as a glass pane and a frame 16 extending peripherally around and embracing the panel 15. The frames 16 have leg portions 17 (FIG. 7) fixed by means of bolts and nuts to base plates 17*a*, which are secured to reinforcements (now shown) supported on floors of the building.

Figure 2:
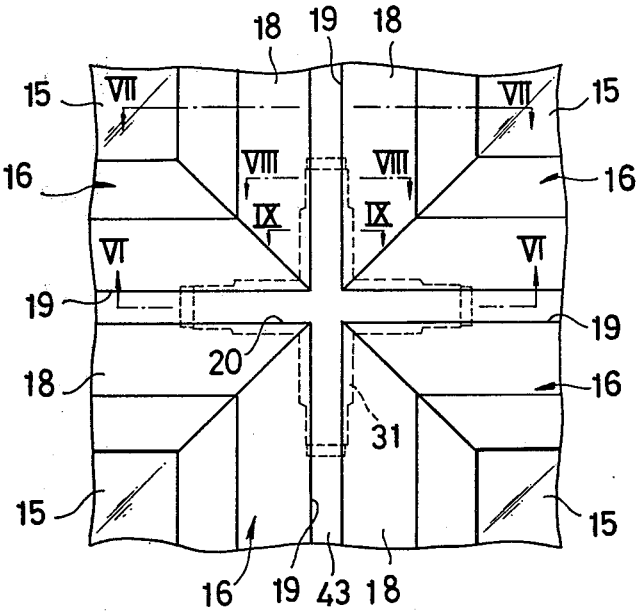
FIG. 2 is an enlarged front elevational view of a portion of the curtain wall construction shown in FIG. 1 in which four panel units meet together.
Figure 3:
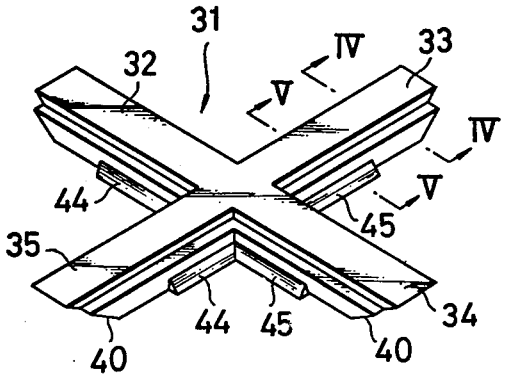
FIG. 3 is an enlarged perspective view of a backup crossing.
Figure 4:
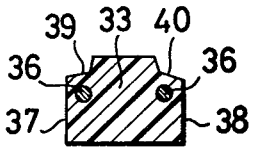
FIG. 4 is an enlarged cross-sectional view taken along line IV — IV of FIG. 3.
Figure 5:
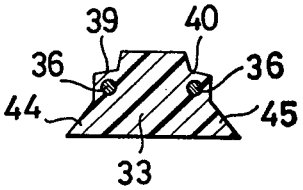
FIG. 5 is an enlarged cross-sectional view taken along line V — V of FIG. 3.
Figure 6:
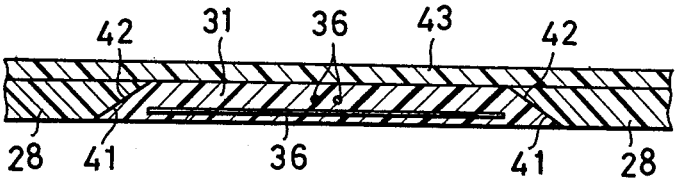
FIG. 6 is an enlarged cross-sectional view taken along line VI — VI of FIG. 2.
Figure 7:
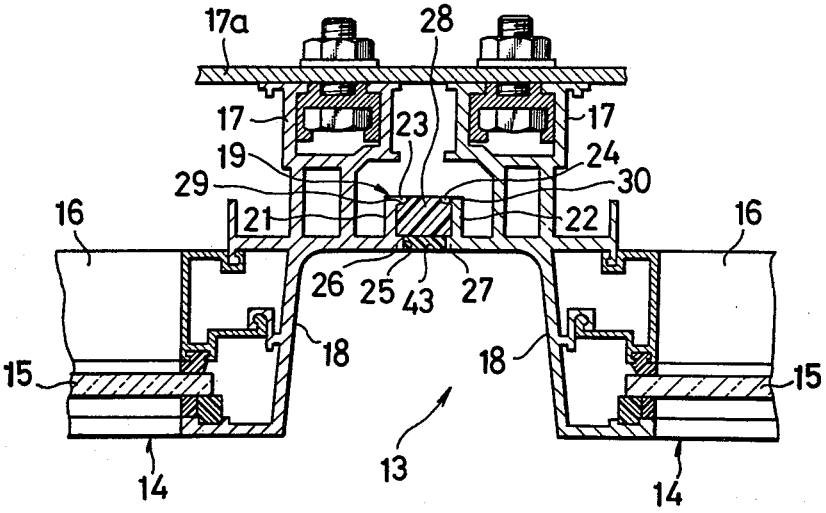
FIG. 7 is an enlarged cross-sectional view taken along line VII — VII of FIG. 2.
Figure 8:
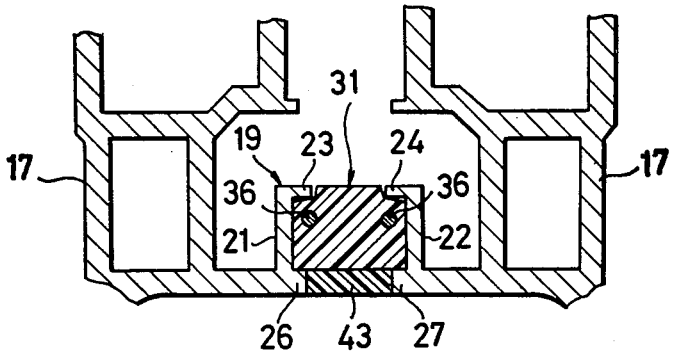
FIG. 8 is an enlarged cross-sectional view taken along line VIII — VIII of FIG. 2.

As shown in FIGS. 2 and 7, each frame 16 has side portions 18 each of which faces a side portion 18 of an adjacent frame 16. Two adjacent frames 16, 16 jointly provide a channel 19 along and between the side portions 18, 18 confronting each other. Thus, four panel units 14 located adjacent to one another jointly provide four channels 19 therebetween which extend substantially perpendicularly to each adjacent channel, the four channels 19 jointly providing a channel crossing 20 where they intersect.

Each channel 19 is provided by a pair of spaced sidewalls 21, 22 on the opposed side portions 18, 18 of adjacent panel unit frames 16, 16, the sidewalls 21, 22 extending away from the panels 15, 15 toward the base plates 17*a*. The sidewalls 21, 22 have on their distal edges a pair of retainer flanges 23, 24, respectively, directed toward each other. Each of the channels 19 has a bottom slot 25 that is coextensive in length with the channel 19 and is bounded by a pair of opposed arms 26, 27 extending from the side portions 18, 18 beyond the sidewalls 21, 22, respectively, toward each other.

A backup bar 28 (FIG. 7) made of a suitable resilient material such as synthetic resin or rubber is disposed in and extends along the channel 19. The backup bar 28 has a pair of grooves 29, 30 in two of its adjacent corners, the grooves 29, 30 extending along the length of the bar 28 and receiving the retainer flanges 23, 24, respectively, of the sidewalls 21, 22.

A backup crossing 31 is disposed in the channel crossing 20, as illustrated in FIG. 2. The backup crossing 31 has four integral legs 32, 33, 34 and 35 each extending at a right angle to both adjacent legs. The integrally constructed backup crossing 31 when subjected to deforming forces by the panel units 14 provides substantially no gap at the channel crossing 20, thereby giving better sealing against dust and water intrusion therethrough. As shown in FIGS. 3 through 6, the backup crossing 31 is also made of a resilient material and has a number of reinforcing core wires 36, namely a pair of wires, such as piano wires, individually embedded in and extending along the legs. Thus one pair of wires crosses a second pair of wires. The reinforcing core wires 36 give the legs increased shear strength such that the backup crossing 31 can retain its integrity when the surrounding panel units 14 are displaced. The core wires 36 are spaced from each other and extend near and parallel to a pair of sidewalls 37, 38 of each leg. A pair of grooves 39, 40 is provided in and along two adjacent corners of each leg.

Each of the backup bars 28 has a beveled end 41 and each of the legs of the backup crossing 31 has a complementally beveled distal end 42, both of the ends 41, 42 being held in abutting engagement with each other for better sealing between the backup bars 28 and the backup crossing 31.

As shown in FIG. 7, a caulking compound 43 is applied to exposed surfaces of the backup crossing 31 and the backup bars 28 and fills the bottom slots 25 of the channels 19, the caulking compound 43 being driven in to the extent that its surface lies flush with the outer surfaces of the arms 26, 27 of the frame side portions 18, 18.

Each leg of the backup crossing 31 has a pair of ridges 44, 45 (FIGS. 3 and 5) on the sidewalls 37, 38 thereof, respectively, the ridges 44, 45 being located at the corners remote from the grooves 39, 40. Lengthwise, the ridges 44, 45 extend outwardly from the center of the backup crossing 31 and terminate short of the distal end 40 of the leg.

Figure 9:
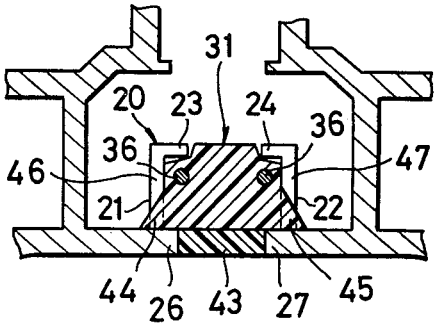
FIG. 9 is an enlarged cross-sectional view taken along line IX — IX of FIG. 2.

There are a pair of recesses 46, 47 in the channel sidewalls 21, 22, respectively, at the channel crossing 20 (FIGS. 9 and 11), the recesses 46, 47 receiving the ridges 44, 45 of each leg of the backup crossing 31 for positional stability thereof.

Figure 10:
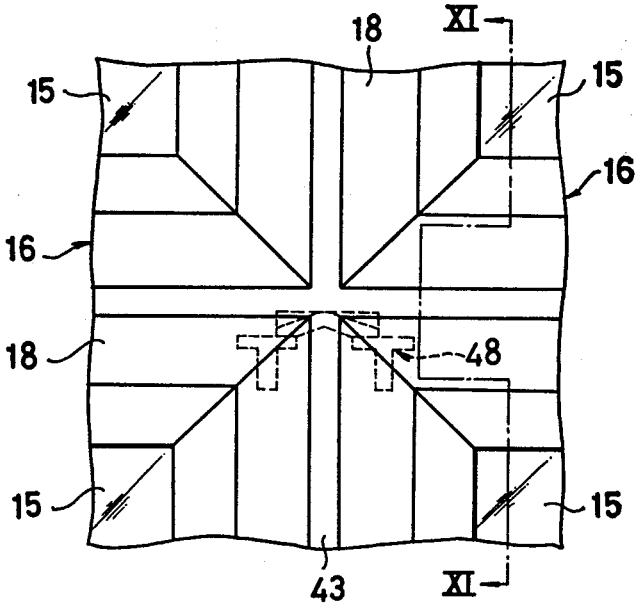
FIG. 10 is a view similar to FIG. 2, showing a drainage device mounted in place.
Figure 11:
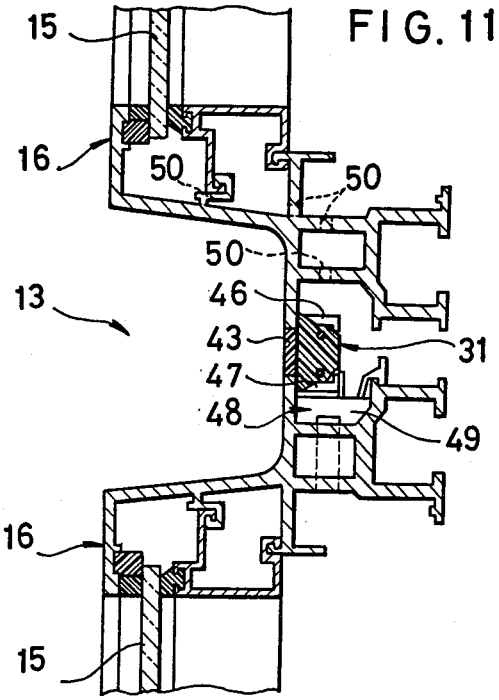
FIG. 11 is an enlarged cross-sectional view taken along line XI — XI of FIG. 10.
Figure 12A:
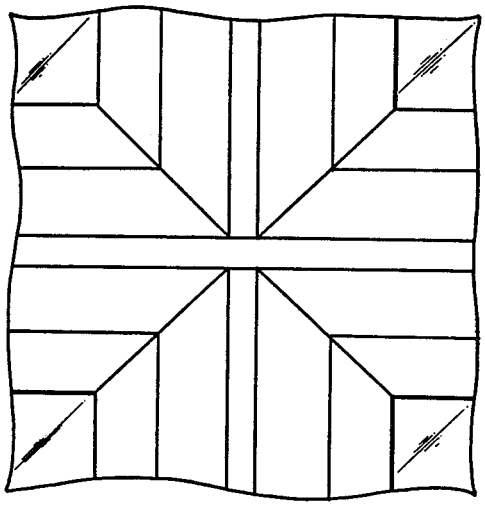
FIG. 12A (PRIOR ART)
FIG. 12A is a fragmentary front elevational view of a conventional curtain wall construction.
Figure 12B:
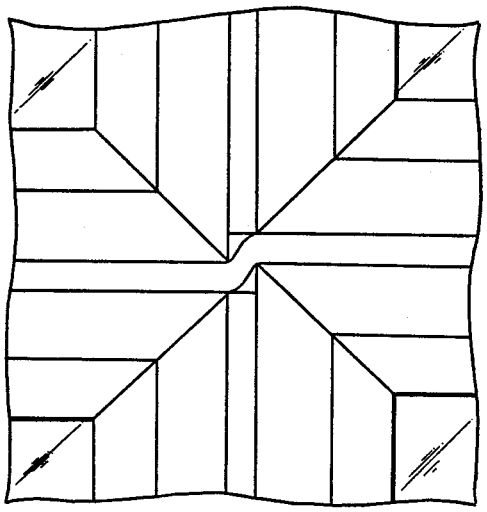
FIG. 12B (PRIOR ART)
FIG. 12B is a fragmentary front elevational view illustrating displaced panel units of the conventional curtain wall construction of FIG. 12A.

As shown in FIGS. 10 and 11, a drainage device 48 is disposed in an adjacent pair of the frames 16 at a position just below the center of the backup crossing 31, the drainage device 48 having a water-collecting receptacle 49 that is located adjacent to the recesses 46, 47 in the channel crossing 20. The drainage device 48 can drain water that may have been trapped in the frames 16 of panel units 14 positioned upwardly of the drainage device 48. For this purpose, the frames have small apertures 50 therein that will allow any entered water to pass therethrough down toward the drainage device 48.

To assemble the curtain wall construction, the panel units 14 with their panels 15 preassembled therein are first fixed to the base plates 17*a*, and the drainage devices 48 are attached in place. Then, the backup crossings 31 are snapped into the channel crossings 20 and the backup bars 28 into the channels 19. The caulking compound 42 is finally applied to the exposed surfaces of the mounted backup crossings 31 and backup bars 28 so as to fill the slots 43.

Although various minor modifications may be suggested by those versed in the art, it should be understood that we wish to embody within the scope of the patent warranted thereon, all such embodiments as reasonably and properly come within the scope of our contribution to the art.

We claim as our invention:

1. A curtain wall construction adapted for being mounted on a building framework, comprising:

(a) at least four spaced panel units each having a panel and a frame extending peripherally around said panel, each frame being adapted to be supported on the building framework, the frames of said four panel units jointly providing four intersecting channels along and between side portions of said frames which face one another, said channels extending substantially perpendicularly to adjacent channels and jointly providing a channel crossing where they intersect, said channels having bottom slots;

(b) a backup crossing disposed in said channel crossing, said backup crossing having four integral legs extending at a right angle to adjacent legs, said backup crossing being made of a resilient material and having reinforcing core wires embedded in each of said legs;

(c) backup bars disposed in said channels and having ends held in abutting engagement with the distal ends of said legs of said backup crossing, said backup bars being made of a resilient material;

(d) a caulking compound applied to exposed surfaces of said backup crossing and backup bars and filling said slots in said channels;

(e) each of said channels being provided by a pair of spaced sidewalls on the opposed side portions of said frame, said sidewalls having on their distal edges a pair of retainer flanges directed toward each other, there being grooves in said backup bars and said legs of said backup crossing, and said retainer flanges being received in said grooves; and (f) there being recesses in said sidewalls, and said legs of said backup crossing having ridges received in said recesses.

2. A curtain wall constructed according to claim 1, including a drainage device mounted in an adjacent pair of said frames and located adjacent to said recesses.

3. A curtain wall construction adapted for being mounted on a building framework, comprising:

(a) at least four spaced panel units each having a panel and a frame extending peripherally around said panel, each frame being adapted to be supported on the building framework, the frames of said four panel units jointly providing four intersecting channels along and between side portions of said frames which face one another, said channels extending substantially perpendicularly to adjacent channels and jointly providing a channel crossing where they intersect, said channels having bottom slots;

(b) a backup crossing disposed in said channel crossing, said backup crossing having four integral legs extending at a right angle to adjacent legs, said backup crossing being made of a resilient material and having reinforcing core wires embedded in each of said legs;

(c) backup bars disposed in said channels and having ends held in abutting engagement with the distal ends of said legs of said backup crossing, said backup bars being made of a resilient material;

(d) a caulking compound applied to exposed surfaces of said backup crossing and backup bars and filling said slots in said channels; and (e) said ends of said backup bars having bevels and said distal ends of said backup crossing having complemental bevels.

4. A curtain wall construction adapted for being mounted on a building framework, comprising:

(a) at least four spaced panel units each having a panel and a frame extending peripherally around said panel, each frame being adapted to be supported on the building framework, the frames of said four panel units jointly providing four intersecting channels along and between side portions of said frames which face one another, said channels extending substantially perpendicularly to adjacent channels and jointly providing a channel crossing where they intersect, each said channel having a bottom slot narrower than said channel;

(b) a backup crossing disposed in said channel crossing, said backup crossing having four integral legs extending at a right angle to adjacent legs, said backup crossing being made of a resilient material;

(c) two pair of reinforcing core wires, one pair crossing the other pair, the wires of one pair being respectively embedded in both of opposite legs, and the wires of the other pair being respectively embedded in both of the other legs, said wires rendering opposite legs non-yieldable with respect to each other in a direction perpendicular to said core wires;

(d) backup bars disposed in said channels and having ends held in abutting engagement with the distal ends of said legs of said backup crossing, said backup bars being made of a resilient material;

(e) each of said legs of the backup crossing and said backup bars having a transverse cross-section which is substantially the same as that of one of said channels; and (f) a caulking compound applied to exposed surfaces of said backup crossing and to exposed surfaces of said backup bars and filling said slots in said channels.

5. A curtain wall construction according to claim 4, each of said channels being provided by a pair of spaced confronting sidewalls on the opposed side portions of said frames, said legs of the backup crossing and said backup bars having surfaces held against said confronting sidewalls, said sidewalls having on their distal edges a pair of retainer flanges directed toward each other, there being grooves in said backup bars and said legs of said backup crossing, and said retainer flanges being received in said grooves.

6. A curtain wall construction according to claim 4, the wires of each of said pairs or reinforcing core wires being spaced from and parallel to each other.

* * * * *